US012644301B2

(12) United States Patent
Dallet et al.

(10) Patent No.: US 12,644,301 B2
(45) Date of Patent: Jun. 2, 2026

(54) DRIVE CONTROLS PRINCIPALLY FOR AUTOMATIC SWIMMING POOL CLEANERS

(71) Applicant: ZODIAC POOL CARE EUROPE, Belberaud (FR)

(72) Inventors: Florent Dallet, Ramonville-Saint-Agne (FR); Simon Duffaut, Castelginest (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 0 days.

(21) Appl. No.: 18/649,517

(22) Filed: Apr. 29, 2024

(65) Prior Publication Data

US 2024/0279953 A1 Aug. 22, 2024

Related U.S. Application Data

(63) Continuation of application No. 16/966,575, filed as application No. PCT/IB2020/056669 on Jul. 16, 2020, now Pat. No. 12,000,169.

(60) Provisional application No. 62/875,599, filed on Jul. 18, 2019.

(51) Int. Cl.
*E04H 4/16* (2006.01)
*G05D 1/00* (2024.01)

(52) U.S. Cl.
CPC ..... *E04H 4/1654* (2013.01)

(58) Field of Classification Search
CPC ..... E04H 4/16; E04H 4/1654; G05D 1/00
See application file for complete search history.

(56) References Cited

U.S. PATENT DOCUMENTS 5,208,521 A * 5/1993 Aoyama ..... G05D 1/027 15/340.1
5,256,207 A * 10/1993 Sommer ..... E04H 4/1654 134/42
5,569,371 A * 10/1996 Perling ..... G05D 1/646 210/167.16
6,299,699 B1 * 10/2001 Porat ..... E04H 4/1654 15/49.1
6,309,468 B1 10/2001 Sommer
7,621,014 B2 * 11/2009 Katz ..... E04H 4/1654 15/319

(Continued)

FOREIGN PATENT DOCUMENTS

EP 0483677 A2 5/1992
EP 3249137 A1 11/2017

(Continued)

OTHER PUBLICATIONS

U.S. Appl. No. 16/966,575, Final Office Action, filed Nov. 9, 2023, 6 pages.

(Continued)

*Primary Examiner* — Tan Q Nguyen
(74) *Attorney, Agent, or Firm* — Kilpatrick Townsend & Stockton LLP

(57) ABSTRACT

Apparatus and methods for counteracting, e.g., drift of automatic swimming pool cleaners are detailed. In particular, a drifting cleaner may recover its movement by altering traction speed of the motive element(s) on one side of its body. Such alteration may occur when the cleaner is travelling along a generally horizontally-oriented pool bottom, climbing up or down a wall, or otherwise moving within a pool.

11 Claims, 1 Drawing Sheet

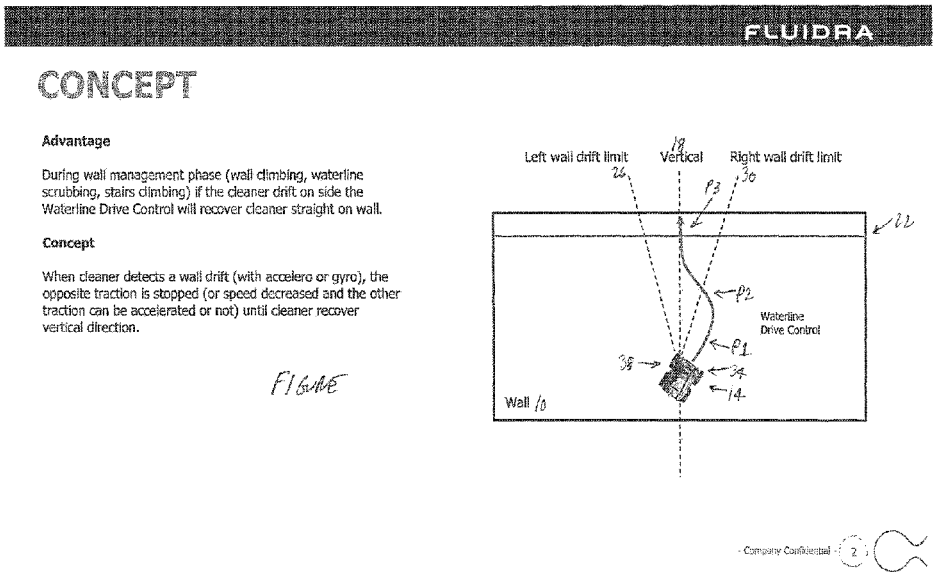

(56) References Cited

U.S. PATENT DOCUMENTS

| | | | | |
|---|---|---|---|---|
| 7,849,547 | B2 * | 12/2010 | Erlich | E04H 4/1654 464/59 |
| 12,000,169 | B2 | 6/2024 | Dallet et al. | |
| 2014/0230168 | A1 * | 8/2014 | Ben Dov | E04H 4/1654 15/1.7 |
| 2015/0027959 | A1 * | 1/2015 | Chouraqui | E04H 4/1654 901/1 |
| 2017/0342733 | A1 * | 11/2017 | Korenfeld | G05D 1/0212 |
| 2019/0243379 | A1 * | 8/2019 | Attar | E04H 4/1654 |
| 2020/0224441 | A1 * | 7/2020 | Witelson | G05D 1/0219 |

FOREIGN PATENT DOCUMENTS

| | | | |
|---|---|---|---|
| WO | 2016137886 | A1 | 9/2016 |
| WO | 2017216784 | A1 | 12/2017 |

OTHER PUBLICATIONS

U.S. Appl. No. 16/966,575, Non-Final Office Action, filed Aug. 16, 2023, 6 pages.

U.S. Appl. No. 16/966,575, Notice of Allowance, filed Feb. 2, 2024, 5 pages.

European Patent Application No. 20743853.2, Office Action, Jan. 30, 2023, 5 pages.

International Application No. PCT/IB2020/056669, International Preliminary Report on Patentability, Jan. 27, 2022, 7 pages.

International Application No. PCT/IB2020/056669, International Search Report and Written Opinion, Nov. 3, 2020, 10 pages.

Australian Application No. 2020312844, First Examination Report mailed on May 29, 2024, 3 pages.

Australian Application No. 2020312844, Notice of Acceptance mailed on Jun. 11, 2024, 3 pages.

European Application No. 20743853.2, Office Action mailed on Sep. 2, 2025, 6 pages.

* cited by examiner

FLUIDRA

CONCEPT

Advantage

During wall management phase (wall climbing, waterline scrubbing, stairs climbing) if the cleaner drift on side the Waterline Drive Control will recover cleaner straight on wall.

Concept

When cleaner detects a wall drift (with accelero or gyro), the opposite traction is stopped (or speed decreased and the other traction can be accelerated or not) until cleaner recover vertical direction.

FIGURE

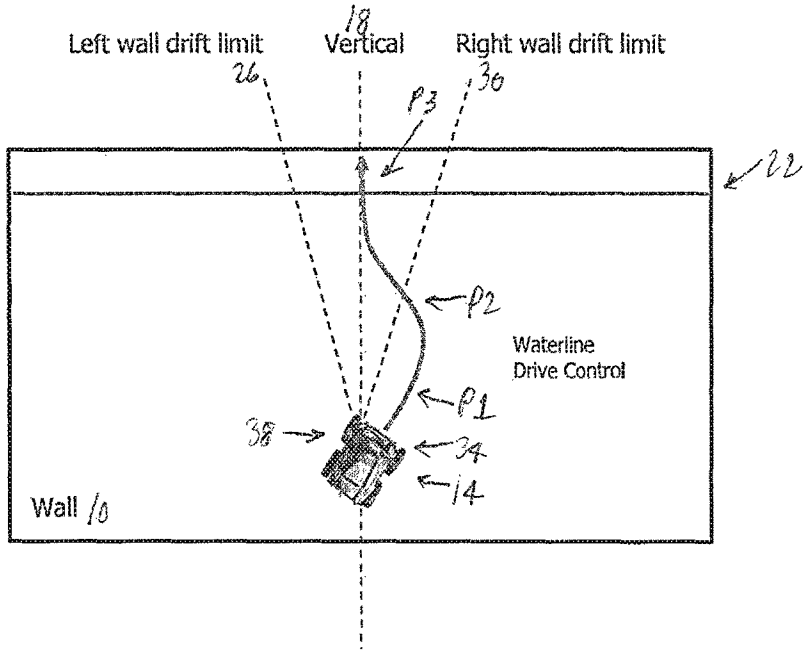

DRIVE CONTROLS PRINCIPALLY FOR AUTOMATIC SWIMMING POOL CLEANERS

CROSS-REFERENCE TO RELATED APPLICATION

This application in a continuation of allowed U.S. patent application Ser. No. 16/966,575, filed Jul. 31, 2020, which application is a national phase entry under 35 USC § 371 of International Application No. PCT/IB2020/056669, filed Jul. 16, 2020, which application claims the benefit of and priority to U.S. Provisional Patent Application Ser. No. 62/875,599, filed Jul. 18, 2019, the entire contents of which are hereby incorporated herein by this reference.

FIELD OF THE INVENTION

This invention relates to systems and methods for controlling cleaning devices and more particularly, although not necessarily exclusively, to automatic swimming pool cleaners (APCs) configured to counter drifting movement on, for example, generally vertically-oriented walls of swimming pools or spas.

BACKGROUND OF THE INVENTION

APCs are well known. These cleaners often are characterized as either "hydraulic" or "robotic" (or "electric"), depending on the source of their motive power. Hydraulic cleaners, for example, typically use pressurized (or depressurized) water to effect their movement within pools, whereas robotic cleaners typically utilize an electric motor to cause their movement. Moreover, hydraulic cleaners frequently are subcategorized as either "pressure-side" or "suction-side" devices, with pressure-side cleaners receiving pressurized water output from an associated water-circulation pump and suction-side cleaners, by contrast, being connected to an inlet of the pump.

Electric motors of robotic cleaners may drive wheels, tracks, or any other suitable mechanisms. If tracks are employed, one track normally is used on each of the left and right sides of a robotic APC. If wheels are utilized, conventionally two (front and rear) are used on each of the left and right sides of the robotic APC, with either the two front or the two rear wheels (or all four wheels) being driven. Shafts, gears, and other standard components may connect the wheels or tracks to the drive motor(s).

Typically, motive means such as tracks or wheels on the left and right sides of a robotic APC are driven at the same speed. Doing so allows the cleaner to travel generally in a forward or rearward direction. Various techniques may be used to cause the robotic APC to reorient its body within a swimming pool and thus change the direction of movement.

APCs engaged in climbing vertical pool walls may encounter difficulties operating against gravity. One such difficulty is generating sufficient power to drive the tracks or wheels upward while maintaining contact with a vertical wall. Another difficulty may be creating sufficient traction to overcome any transient currents in the pool or starting conditions of climbing that might tend to cause an APC to drift laterally.

BRIEF DESCRIPTION OF THE DRAWINGS

The FIGURE illustrates a vertical wall of a swimming pool together with an APC.

DESCRIPTION OF THE INVENTION

The present invention seeks to provide systems and methods of counteracting lateral such drift. Especially useful when an APC is climbing (up) a generally vertically-oriented wall, the invention also may be employed with the APC is travelling along a generally horizontally-oriented pool bottom, climbing down a wall, or otherwise moving within a pool. In particular, the present invention may allow a drifting cleaner to recover its upward movement along a wall by altering traction speed of the track or wheels on one side of the body of the APC.

This concept is illustrated schematically in the FIGURE. Shown therein is generally vertical wall 10 of a swimming pool together with APC 14. Also depicted in the FIGURE in dotted lines is vertical line 18.

If appropriate, APC 14 may be controllable electronically and include at least one orientation sensor such as (but not necessarily) an accelerometer, a gyroscope, or otherwise. At times, APC 14 may be commanded or configured to climb from a floor or bottom of the pool to its waterline 22 in order to clean wall 10, especially in the region adjacent waterline 22. Such instruction to APC 14 may be to climb vertically along vertical line 18, for example.

Further illustrated in the FIGURE in dotted lines are (nominally) left line 26 and (nominally) right line 30, each forming an angle with vertical line 18. These lines 26 and 30 may exemplify angular drift limits permissible while APC 14 climbs wall 10. Angles formed with respect to vertical line 18 by lines 26 and 30 need not be limited to any particular values, but normally will be greater than 0° and less than ±90°.

Under the example conditions depicted in the FIGURE, APC 14 is climbing vertical wall 10 initially along path P1. This path P1 is angled relative to vertical line 18, illustrating that APC 14 is drifting from the vertical line 18. As the orientation sensor detects that path P1 has equaled or exceeded the drift limit established by the angle between lines 18 and 30, a controller of the APC 14 may signal its drive mechanism to change the traction speed of the motive elements on either the left or the right side of the body of the cleaner 14 so that the speeds are unbalanced. For example, consistent with the FIGURE, speed of the (nominally) right motive means 34 of the APC 14 may be increased so as to turn the body of APC 14 leftward to follow a path P2 closer to vertical line 18. Alternatively, speed of the (nominally) left motive means 38 may be decreased to cause APC 14 to follow path P2. When the orientation sensor senses that APC 14 has returned to a more vertical path, the controller may instruct the drive mechanism to balance the traction speeds of motive means 34 and 38 and allow APC 14 to follow path P3.

Persons skilled in the art will recognize that the unbalanced traction speeds discussed herein may be achieved in any suitable manner. In some versions of APC 14, more than one drive motor may be employed, with the motors operating at different speeds to drive wheels or tracks at different velocities. In other versions of APC 14, a single motor may be geared differently as connected to different tracks or wheels so as to produce different traction speeds. Other techniques recognizable by skilled persons alternatively or additionally may be utilized.

Although the FIGURE schematically illustrates APC 14 climbing up wall 10, systems and methods of the invention could be used when APC 14 is climbing down wall 10 or moving in some other manner with the swimming pool. In such cases other or additional orientation sensors may be needed. Nonetheless, upon detection of a drift or other change of intended course, a sensor and controller of APC 14 may unbalance the left and right traction speeds of the motive means of the cleaner to implement a course correction.

Exemplary concepts and combinations of features of the invention may include:

A. A method of causing an automatic swimming pool cleaner having a body to counteract a deviation from an intended course.

B. A method according to statement A. in which counteraction of the deviation from the intended course occurs by driving a first motive element on a first side of the body at a different speed than a second motive element on a second side of the body opposite the first side.

C. An automatic swimming pool cleaner comprising a body, an orientation sensor, a controller, at least one drive mechanism, a first motive element on a first side of the body, and a second motive element on a second side of the body opposite the first side; and in which the at least one drive mechanism is configured to drive the first motive element at a different speed than the second motive element upon command of the controller when the orientation sensor senses that the body is oriented in a manner other than planned.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within their definitions.

What is claimed is:

1. A method comprising:

receiving or identifying a target region within a swimming pool for an automatic swimming pool cleaner;

monitoring the automatic swimming pool cleaner for lateral drift while the automatic swimming pool cleaner is climbing a vertical wall and relative to the target region; and responsive to a detected lateral drift, causing the automatic swimming pool cleaner to drive first and second motive elements of the automatic swimming pool cleaner in an unbalanced manner to counteract the lateral drift.

2. The method of claim 1, wherein the target region is a region adjacent a waterline of the swimming pool.

3. The method of claim 1, wherein the method further comprises monitoring the automatic swimming pool cleaner relative to a drift limit, and wherein the drift limit is defined relative to a vertical line.

4. The method of claim 3, wherein the drift limit is from −90° to 90° relative to the vertical line.

5. An automatic swimming pool cleaner comprising:

a body;

first and second motive elements; and a controller, wherein the controller is configured to:

cause the automatic swimming pool cleaner to advance toward a target region by driving the first and second motive elements;

monitor the automatic swimming pool cleaner for lateral drift while the automatic swimming pool cleaner is climbing a vertical wall and relative to the target region; and responsive to a detected lateral drift, causing the automatic swimming pool cleaner to drive first and second motive elements of the automatic swimming pool cleaner in an unbalanced manner to counteract the lateral drift.

6. The automatic swimming pool cleaner of claim 5, wherein the first and second motive elements are on opposite sides of the body.

7. The automatic swimming pool cleaner of claim 5, wherein the first and second motive elements comprise tracks or wheels.

8. The automatic swimming pool cleaner of claim 5, further comprising at least one drive mechanism, wherein the controller is configured to drive the first and second motive elements by signaling the at least one drive mechanism.

9. The automatic swimming pool cleaner of claim 5, wherein the controller is configured to receive or identify the target region at a region adjacent a waterline of the swimming pool.

10. The automatic swimming pool cleaner of claim 5, further comprising at least one orientation sensor on the automatic swimming pool cleaner and configured to detect a path of the automatic swimming pool cleaner relative to the target region.

11. The automatic swimming pool cleaner of claim 10, wherein the at least one orientation sensor comprises an accelerometer or a gyroscope.

* * * * *